United States Patent [19]

Lederer et al.

[11] Patent Number: 4,615,452

[45] Date of Patent: Oct. 7, 1986

[54] COMPOUND TOROIDAL TANKS

[75] Inventors: Richard W. Lederer, Bellevue; Max D. Musgrove, Mercer Island; Robert E. Jones, Issaquah, all of Wash.

[73] Assignee: The Boeing Company, Seattle, Wash.

[21] Appl. No.: 627,633

[22] Filed: Jul. 3, 1984

[51] Int. Cl.[4] ..... B65D 8/04; B65D 25/04

[52] U.S. Cl. ..... 220/1 B; 220/5 A; 220/22; 220/83

[58] Field of Search ..... 220/1 B, 3, 5 A, 22, 220/83; 114/256, 257; 244/158 R, 159

[56] References Cited

U.S. PATENT DOCUMENTS

| | | | |
|---|---|---|---|
| 2,341,044 | 2/1944 | Jackson et al. | 220/3 |
| 2,457,118 | 12/1948 | Boardman . | |
| 2,462,064 | 2/1949 | Boardman . | |
| 2,668,634 | 2/1954 | Arne . | |
| 2,672,254 | 3/1954 | Boardman . | |
| 2,920,784 | 1/1960 | Boardman | 220/1 B |
| 3,016,938 | 1/1962 | Akrep | 220/5 A |
| 3,414,153 | 12/1968 | Leroux | 220/1 B |
| 3,472,414 | 10/1969 | Rodrigues . | |
| 3,528,582 | 9/1970 | Risollot | 220/5 A |
| 3,608,767 | 9/1971 | Elliott et al. . | |
| 3,612,329 | 10/1971 | Parks et al. | 220/1 B |
| 3,814,042 | 6/1974 | Hirowatari | 114/257 |
| 4,343,409 | 8/1982 | Silver . | |

FOREIGN PATENT DOCUMENTS

| | | | |
|---|---|---|---|
| 645965 | 9/1962 | Italy | 220/3 |

OTHER PUBLICATIONS

"New Module to Orbit Satellites", *Aviation Week and Space Technology*, p. 139, Nov. 28, 1983.

*Primary Examiner*—Allan N. Shoap

*Attorney, Agent, or Firm*—Finnegan, Henderson, Farabow, Garrett & Dunner

[57] ABSTRACT

A tank for containing fluids, comprising at least two connected concentric toroid cells sharing a common axis, is provided. Each of the toroid cells encloses a hollow interior for holding the fluids. One or more surfaces separate adjacent toroid cells. Each of the surfaces appear in any cross section taken through the common axis as two equal line segments being positioned symmetrically about the common axis.

6 Claims, 6 Drawing Figures

COMPOUND TOROIDAL TANKS

FIELD OF THE INVENTION

The present invention relates to tanks for fluids and, more particularly, to compound toroidal tanks.

BACKGROUND OF THE INVENTION

Typically, conventional toroidal tanks are constructed of a single cell that contains in the one cell all of the fluids held by the toroidal tank. For example, the conventional toroidal tank 4, illustrated in FIG. 1, has a single toroid cell 5 that encloses a hollow interior 6. All of the fluid is contained within the single cell 5.

In many instances, however, single cell toroidal tanks fail to provide all of the design and structural features that are desired in a toroidal tank. Conventional single cell toroidal tanks do not provide sufficient external clearance, volume, significant slosh control, proper weight, strength, and structural stability, significant stiffness, easy drain and fill characteristics, and necessary support characteristics.

SUMMARY OF THE INVENTION

Therefore, a main objective of the present invention is a tank for containing fluids that overcomes the aforementioned drawbacks.

It is a more specific objective of the present invention to increase the degree of strength and stiffness of a tank for containing fluids.

It is also an objective of the present invention to enhance the slosh control and drain efficiency of the tank.

Additional objectives and advantages of the invention will be set forth in the description that follows, and in part will be obvious from the description, or may be learned by practice of the invention. The objectives and advantages of the invention may be realized and obtained by means of instrumentalities and combinations particularly pointed out in the appended claims.

To achieve these and other objectives, the present invention provides a tank for fluids comprising at least two connected concentric toroid cells sharing a common central axis. Each of the toroid cells encloses a hollow interior for holding the fluids. One or more surfaces separate adjacent toroid cells. Each of the surfaces appear in any cross section taken through the common axis as two equal line segments being positioned symmetrically about the common axis.

The present invention overcomes the inherent disadvantages of previous conventional toroidal tanks of single cell design and meets the various objectives of the invention. The tank of the present invention provides the desired degree of strength and stiffness for containing various fluids. The tank exhibits enhanced strength and stiffness in comparison to conventional toroidal tanks that are manufactured as a single cell.

When the tank of the present invention is pressurized with equal pressure in adjacent cells, the dominant stress in all directions along the surfaces separating adjacent toroid cells is similar to a membrane in tension. The surfaces separating the adjacent toroid cells act as deep beams or webs to give the cells strength and stiffness that are not obtained in single cell toroidal tanks of comparable size and weight. These surfaces are also very effective in reacting to support loads to produce the required stiffness, even though buckles may be present in the individual elements.

When transverse or radial flat bulkheads are also used, additional strength, stiffness, and slosh control occur. The intersection of these flat transverse bulkheads and the circumferential internal members are particularly useful in providing external attachment and support points.

The foregoing and other objectives, features, and advantages of the present invention will be made more apparent from the following description of the preferred embodiments.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

Reference will now be made in detail to the present preferred embodiments of the invention, examples of which are illustrated in the accompanying drawings.

Figure 1:
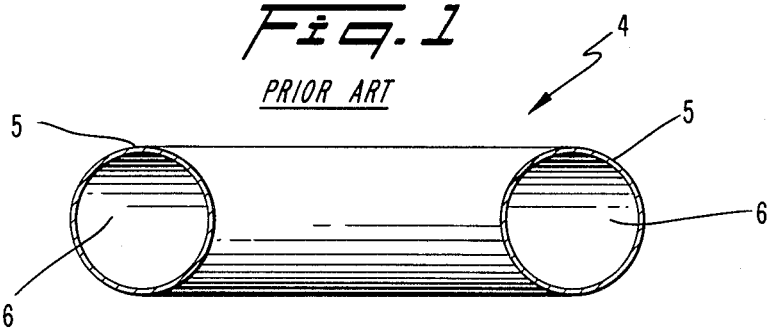
Fig. 1 PRIOR ART
FIG. 1 is a prior art, conventional toroidal tank of single cell design.
Figure 2:
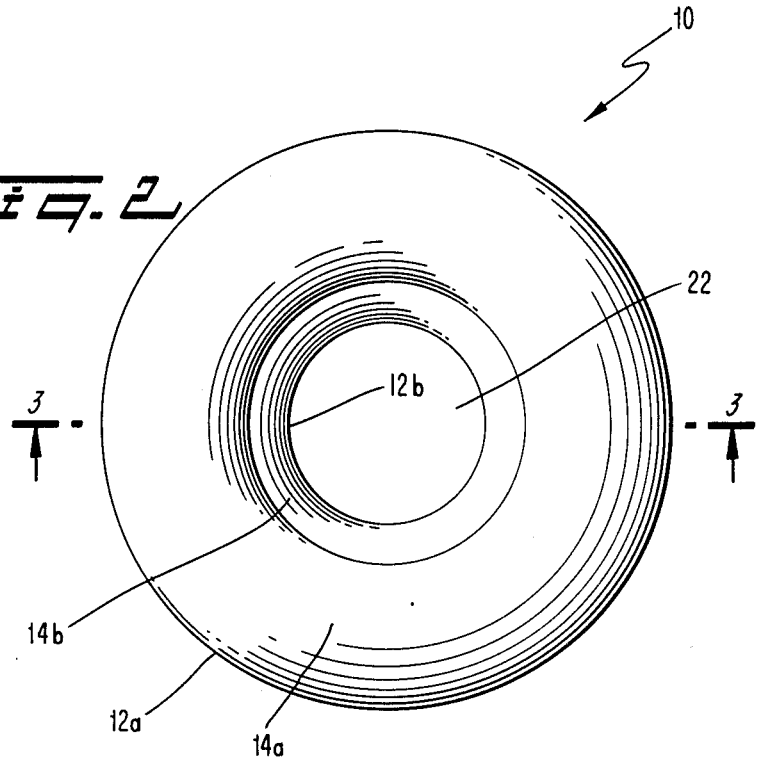
FIG. 2 is a plan view of a tank of the present invention.
Figure 3:
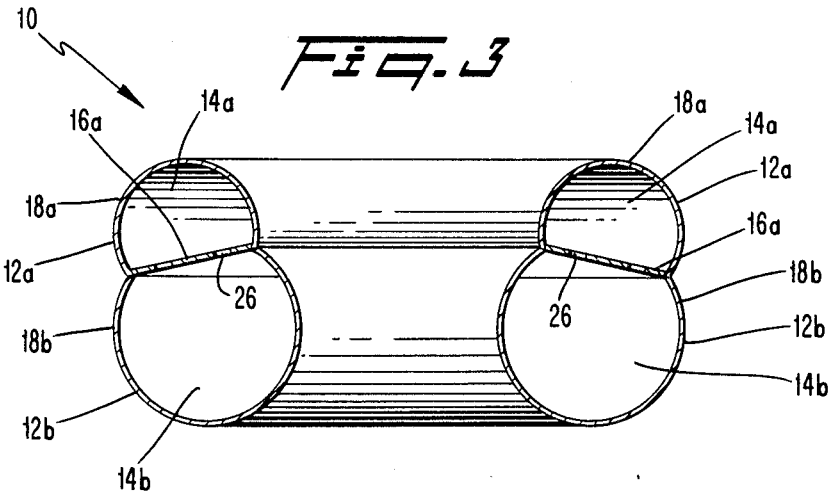
FIG. 3 is a cross-sectional view of the tank of FIG. 2 taken along line 3—3.

In accordance with the present invention, toroid tank 10, illustrated in FIG. 2, contains fluids and comprises at least two connected concentric toroid cells, shown by toroid cells **12*a* and 12*b*, in FIG. 3, sharing a common central axis. Each of the toroid cells encloses a hollow interior for holding the fluids. For example, in FIG. 3, toroid cells 12*a* and 12*b*, and enclose respectively hollow interiors 14*a* and 14*b***.

One or more surfaces, such as surface **16*a* in FIG. 3, separate adjacent toroid cells. Each of the surfaces appears in any cross section taken through the common axis as two equal line segments, such as straight line segments, being positioned symmetrically about the common axis. Each surface between adjacent cells can also contain one or more holes to allow for the flow of fluid and equalization of pressure between adjacent toroid cells. As used herein, the term straight line segments includes discontinuous straight line segments as shown in FIG. 3** where the discontinuities represent holes in the surface.

As used herein, the term toroid means any solid generated by the rotation of any closed planar curve about an axis lying in a plane of the curve and not intersecting the curve. In one embodiment of the present invention, the closed planar curve that is rotated to generate a toroid describing the shape of each toroid cell is a truncated circle. This shape for a cell provides between adjacent toroid cells a common surface that appears in a cross section through the common axis as two equal line segments.

For example, toroid cells 12*a* and 12*b* in FIG. 3 have cross-sections taken through the common axis which appear as equal truncated circle pairs, 18*a* and 18*b* respectively, located symmetrically about the axis. As noted above, the truncated circles provide common surfaces, such as surface 16*a*, between adjacent toroid cells. Such surfaces increase the strength and stiffness of the toroid cells. Surface shapes other than ones having the above defined straight line segment, such as a crooked line segment, can also be used to separate the toroid cells, if the common surface has sufficient strength and stiffness.

Figure 4:
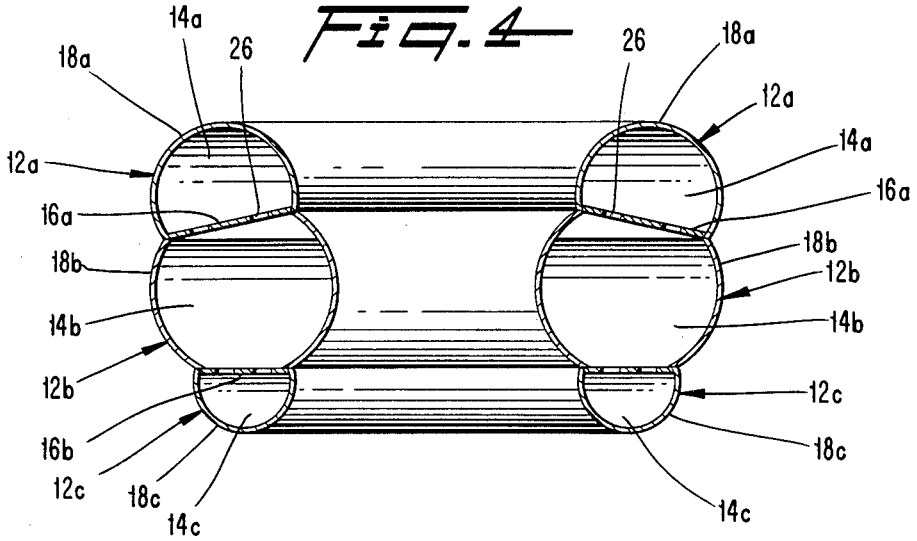
FIG. 4 is a cross-sectional view of an alternative embodiment of the tank of FIG. 2 taken along line 3—3.

In one embodiment, as shown in FIG. 4, a third toroid cell 12*c* is added to the two toroid cells 12*a* and 12*b* of FIG. 3 to produce a tank having three toroid cells including two exterior toroid cells 12*a* and 12*c* and one middle toroid cell 12*b*. The middle toroid cell 12*b* is positioned between the two exterior toroid cells 12*a* and 12*c*.

In the configuration shown in FIG. 4, each exterior toroid cell 12*a* and 12*c* encloses, respectively, the hollow interiors 14*a* and 14*c* for containing the fluids. The two exterior toroid cells 12*a* and 12*c* are attached to the middle toroid cell 12*b* by the surfaces 16*a* and 16*b*. Each surface 16*a* and 16*b* appears in any cross section taken through the common axis as two equal length line segments being positioned symmetrically about the common axis. The surface 16*a* separates toroid cells 12*a* and 12*b*, and the surface 16*b* separates the toroid cells 12*b* and 12*c*.

The surfaces 16*a* and 16*b* strengthen and distribute the stress present in the toroid cells 12*a*, 12*b*, and 12*c*. Those various surfaces, act as beams or webs to give the toroid cells added strength and stiffness, even under pressurized conditions, that is not provided by conventional toroidal tanks having only one cell. For example, the surfaces 16*a* and 16*b* in FIG. 4, which connect the middle toroid cell 12*b* to the two exterior toroid cells 12*a* and 12*c*, are very effective in reacting to torsion loads to produce sufficient torsional stiffness, even when buckling is present in the middle cell 12*b*. The surfaces 16*a* and 16*b* are particularly useful in reacting to support loads applied at the intersection of the toroid cells, such as the intersection of the toroid cells 12*a* and 12*b*.

Figure 5:
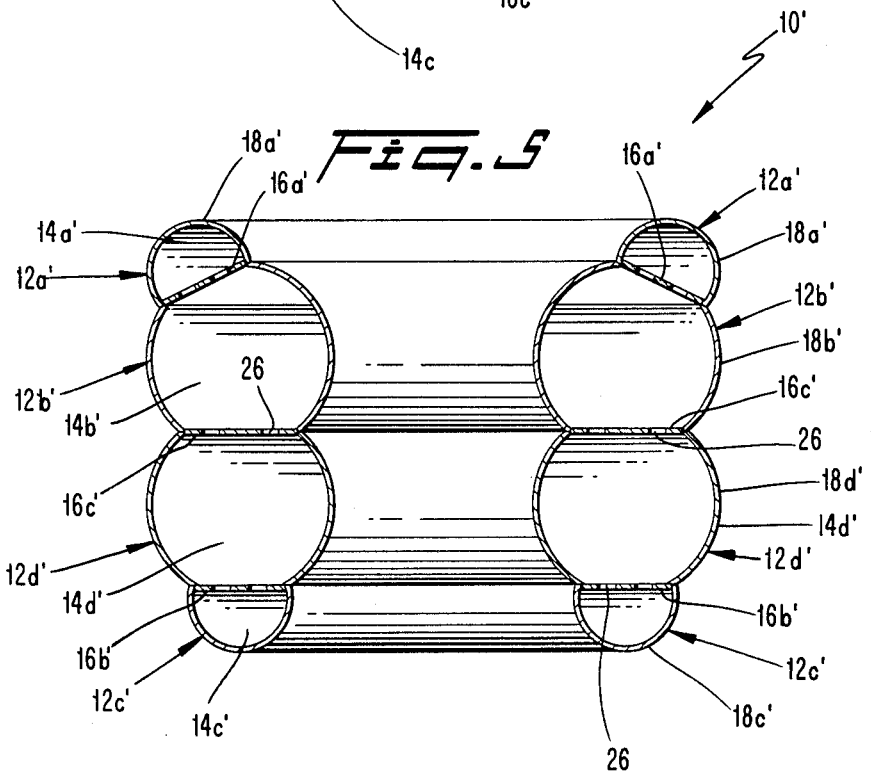
FIG. 5 is a cross-sectional view of another alternative embodiment of the tank shown in FIG. 2 taken along line 3—3.

Strength and stiffness for support may also be further enhanced by use of transverse or radial flat bulkheads 19, as shown in FIG. 3, at the support points and perpendicular to the surfaces 16*a* and 16*b*. The bulkhead 19, for example is positioned within the hollow interior 14*a* of the toroid cell 12*a*. As a result, additional slosh control occurs. The two exterior toroid cells 12*a* and 12*c* can have the same size and shape; however, diverse cross-sectional areas are also within the scope of the invention. The toroid cells can have either circular or noncircular cross sections. The various surfaces 16*a* and 16*b* of each tank shown in FIG. 4, likewise, need not be of the same size and shape. A tank 10′ according to the present invention, can also include four toroid cells 12*a*′, 12*b*′, 12*c*′, and 12*d*′, as depicted in FIG. 5. In this embodiment, the four toroid cells include two exterior toroid cells 12*a*′ and 12*c*′ enclosing hollow interiors 14*a*′ and 14*c*′ respectively, and two middle toroid cells 12*b*′ and 12*d*′ enclosing hollow interiors 14*b*′ and 14*d*′. The two middle toroid cells 12*b*′ and 12*d*′ are attached together by surface 16*c*′. Each exterior toroid cell 12*a*′ and 12*c*′ is connected to one of the middle toroid cells 12*b*′ and 12*d*′ by one of the surfaces 16*a*′ and 16*b*′. Each surface 16*a*′, 16*b*′, and 16*c*′ appears in any cross section taken through the common axis as two equal length straight line segments positioned symmetrically about the common axis.

Figure 6:
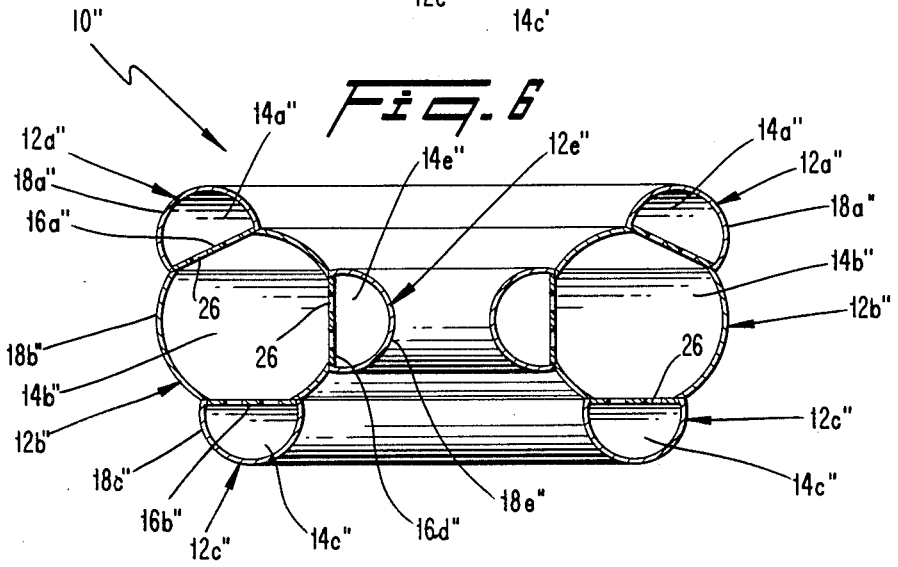
FIG. 6 is a cross-sectional view of another alternative embodiment of the tank shown in FIG. 2 taken along line 3—3.

In the embodiment of the present invention shown in FIG. 6, an embodiment of the tank 10″ of this invention includes four toroid cells comprising two exterior toroid cells 12*a*″ and 12*c*″ enclosing hollow interiors 14*a*″ and 14*c*″, one middle toroid cell 12*b*″ enclosing hollow interior 14*b*″, and one interior toroid cell 12*e*″ enclosing hollow interior 14*e*″. The interior cell 12*e*″ is positioned within the central opening 22 of the middle toroid cell 12*b*″. The middle toroid cell 12*b*″ is connected by surfaces 16*a*″, 16*b*″, and 16*d*″ to the two exterior toroid cells 12*a*″ and 12*c*″ and the interior toroid cell 12*d*″.

Other tanks having a different arrangement of toroid cells and either circular or noncircular cross sections are developed within the scope of the invention. These complex multi-cell tanks permit a much lower structural weight and higher structural efficiency than conventional toroidal tanks due to the strength and stiffness provided to the toroid cells by the intercell surfaces.

The selection of a particular tank among the tanks shown in FIGS. 3 to 6 depends upon the proposed use of the tank. For example, the tank 10″ shown in FIG. 6 can fit into a smaller space than the tank 10′ of FIG. 5 having like dimensions, since the tank 10″ has the interior toroid cell 12*e*″ positioned within the central opening 22 of the middle toroid cell 12*b*″.

The materials, dimensions, number, and placement of the toroid cells shown in FIGS. 3 to 6 depend upon the design and ultimate use of the particular tank with which they are used. With this description of the invention, the artisan of ordinary skill can design a tank for his desired application. For example, when liquid oxygen is to be contained within the tank, the toroid cells are typically made from aluminum. When other fluids are within the tank, other metals, such as titanium, can be used. Composite materials can similarly be used.

Preferably, the surfaces each have a plurality of holes 26 shown in FIGS. 3–6 to allow for the flow of the fluid and equalization of pressure between adjacent toroid cells. For example, surface 16*a* in FIG. 3 has drain holes 26 to permit fluid flow between hollow interiors 14*a* and 14*b* of the exterior toroid cell 12*a* and the middle toroid cell 12*b*. These drain holes 26, accordingly, permit fluid to flow from one hollow interior 12*a* to the adjacent hollow interior 12*b*, while surface 16*a* helps reduce the sloshing of the fluid. Such sloshing also aids in the dissipation of waves and energy that build up within the contained fluid. Since the area occupied by the holes in each surface is minimal with respect to the total area of the surface, the presence of the holes have a negligible effect on the strength and rigidity of the surface.

The various tanks of the present invention, shown in FIGS. 2–6, can be used in flight vehicles, such as aircraft or spacecraft, to contain a fuel or propellant. In such a use, the tanks usually are normally positioned within the fuselage of the flight vehicle. The tank can also be used on land to contain various fluids, such as cryogenic liquids.

It will be apparent to those skilled in the art that various other modifications and variations could be made in the structure of the invention without departing from the scope and content of the invention.

What is claimed is:

1. A tank for fluids, said tank comprising:

at least two connected toroid cells one on top the other sharing a common central axis, each of the toroid cells enclosing a hollow interior for holding the fluids, at least one of the connected toroid cells being symmetrically offset with respect to the center of its hollow interior from a ring of axes parallel to said central axis and intersecting the center of the hollow interior of the adjacent cell, the offset cell and the adjacent cell being truncated along their common boundary and separated thereat by a frustoconical bulkhead having apertures therethrough for allowing the fluids to flow and pressure to equalize between the cells.

2. The tank of claim 1 wherein there are three of said connected toroid cells.

3. The tank of claim 1 wherein there are three of said connected toroid cells and an additional toroid cell shares a common side boundary with one of said connected toroid cells along the radial inner side thereof.

4. The tank of claim 1 wherein there are four of said interconnected toroid cells.

5. The tank of any one of claims 1–4 wherein at least two cells having differing interior diameters.

6. The tank of any one of claims 2–5 wherein at least two cells having differing exterior diameters.

* * * * *